United States Patent [19]

Guolo

[11] 3,956,796

[45] May 18, 1976

[54] LACING DEVICE FOR SKI BOOTS

[75] Inventor: Giuseppe Guolo, Montebelluna, Italy

[73] Assignee: Calzaturificio Giuseppe Garbuio S.A.S., Treviso, Italy

[22] Filed: May 19, 1975

[21] Appl. No.: 578,815

[30] Foreign Application Priority Data

May 20, 1974 Italy ..... 84122/74

[52] U.S. Cl. ..... 24/70 SK; 36/50

[51] Int. Cl.[2] ..... A43C 11/00; A43B 11/00

[58] Field of Search ..... 36/2.5 AL, 50; 24/68 SK, 69 SK, 70 SK, 68 R, 69 R, 69 ST, 70 R

[56] References Cited

UNITED STATES PATENTS

| | | | |
|---|---|---|---|
| 2,215,221 | 9/1940 | Levine | 24/70 SK |
| 3,333,302 | 8/1967 | Klima | 24/70 SK |
| 3,738,027 | 6/1973 | Schoch | 36/50 |

*Primary Examiner*—Patrick D. Lawson
*Attorney, Agent, or Firm*—B. P. Fishburne, Jr.

[57] ABSTRACT

A lacing device for ski boots of the kind comprising a hooked lever like member cooperating with a ring like member, the said lacing members being secured to the ski boot upper, at both sides of the longitudinal opening formed in the ski boot upper. To this end, the said lacing members are each fastened to a base plate which may be assembled in an easily dismountable manner with a sliding fit on a slide guide formed on the ski boot upper. Abutment means are provided for limiting the movement of the said base plate with respect to the cooperating slide guide.

9 Claims, 6 Drawing Figures

LACING DEVICE FOR SKI BOOTS

BACKGROUND AND SUMMARY OF THE INVENTION

This invention relates to a lacing device for ski boots. The modern ski boots are provided with a number of lacing devices each comprising a hooked lever like member cooperating with a ring like member. The said members are fastened to base plates, which in turn are secured to the ski boot upper, at both sides of the longitudinal opening formed in the upper, usually by means of rivets.

In the event that one of the said devices becomes irreparably damaged, its substitution is very difficult, and may be accomplished only by a skilled person with the aid of special tools and with the serious risk of damaging the ski boot.

The invention aims to obviate to the above drawbacks of the prior art lacing devices, by providing a lacing device which may be easily assembled and disassembled from a ski boot, without the need of tools, and without the danger of damaging the ski boot.

According to one feature of the invention, this is obtained by fastening the said lacing members to a base plate which may be assembled in an easily dismountable manner with a sliding fit on a slide guide provided on the ski boot upper.

Advantageously the said slide guide has a dovetail or a T shaped profile, and the correspondingly profiled base plate is inserted with a frictional fit on the said slide guide, abutment means being provided for limiting the sliding movement of the base plate with respect to the slide guide.

BRIEF DESCRIPTION OF THE DRAWINGS

Further object and advantages of the invention will become apparent from the following specification, made with reference to the accompanying drawings, in which.

DESCRIPTION OF THE PREFERRED EMBODIMENT OF THE INVENTION

Figure 2:
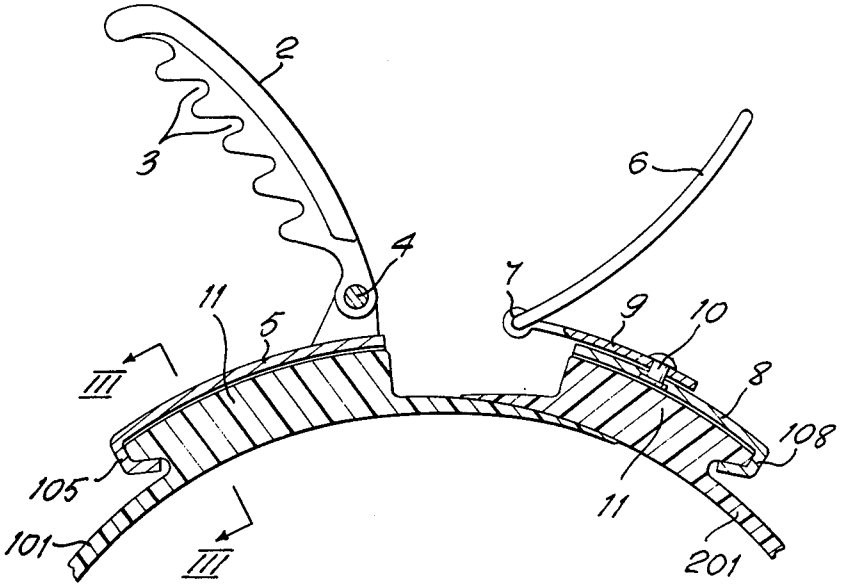
FIG. 2 is an enlarged transversal section of the lacing device shown in FIG. 1.
Figure 1:
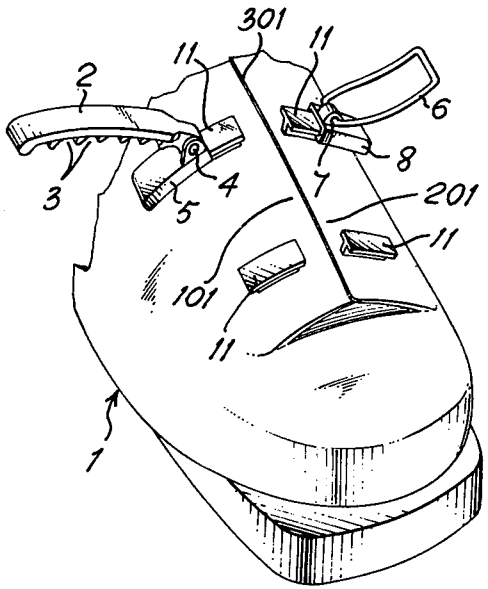
FIG. 1 is perspective view of the broken away front portion of a ski boot provided with a lacing device according to the invention.
Figure 3:
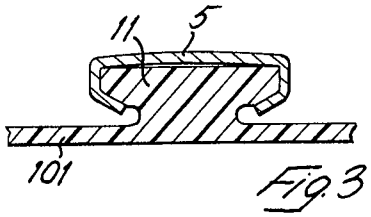
FIG. 3 is a cross sectional view taken along line III—III of FIG. 2.

With reference to FIGS. 1 to 3, numeral 1 denotes a ski boot made of plastic material. The ski boot upper is provided, in conventional manner, with two flaps 101, 201 defining between them the opening 301. To the said flaps 101, 201, the lacing devices are secured. To this end, the flaps 101 and 201 are provided with a number of slide guides 11, projecting outwardly therefrom. In the embodiment shown, the said slide guides are made integral with the said flaps, and have a substantially T shaped profile in cross section. The said slide guides 11 are disposed in confronting pairs on the flaps 101, 201. On the said slide guides, the lacing devices are mounted. The lacing devices are each formed by a pair of lacing elements. One of the said lacing elements comprises a lever arm 2 provided at one side with a plurality of hook like indentations 3. The said lever arm 2 is hingedly connected at one end through a pivot pin 4 to a base element 5, which is in the form of slide member having a profile in cross section mating the profile of the slide guide 11. In the embodiment shown in FIGS. 1 to 3, both the slide guide 11 and the mating slide member 5 are curved in their longitudinal direction, that is the direction of their sliding engagement. The said slide elements are so dimensioned as to assure a certain frictional engagement between slide member 5 and slide guide 11.

The second lacing element comprises a ring like element 6, hingedly connected to the eyelet 7 formed at one end of a plate 9, secured at its other end through a rivet 10 to a slide member 8, equal to slide member 5 previously described.

The slide members 5 and 8 are each provided at their rear end with a downwardly projecting abutment member 105, 108 which whenever the slide members 5, viz. 8 are inserted on the slide guides 11, limits the stroke of the said slide members with respect to the guides 11, by abutment against the rear ends of the slide guides 11.

The operation of the device described is evident. Whenever it is necessary to substitute one lacing device, the old one is simply extracted from the slide guides 11, and the new one is inserted on the said slide guides.

DESCRIPTION OF TWO FURTHER EMBODIMENTS OF THE INVENTION

Figure 4:
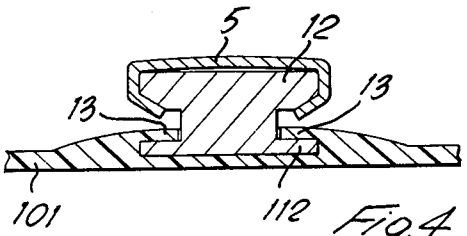
FIG. 4 is a cross sectional view similar to FIG. 3, of a second embodiment of the invention.

In FIG. 4 a second embodiment of the invention is shown. According to this embodiment, the slide guides 12 are not made integral with the ski boot flaps. The said slide guides 12 have a substantially H shaped cross sectional profile. The flaps 101, 201 of the ski boot are provided with substantially inverted T shaped cuts 112 formed in their thickness, extending the whole length of the slide guides 12, in which cuts 112 the lower wings of the slide guide profiles are embedded and firmly maintained by the overlapping portions 13 of the ski boot flaps. Advantageously, the ski boot flaps 101, 201 present an increased thickness in the regions in which the said slide guides are to be secured to the ski boot. It is also possible to embed the said slide guides into the ski boot flaps during the molding of the ski boot upper.

Figure 6:
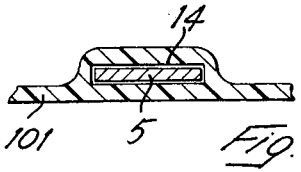
FIG. 6 is a cross sectional view taken along line VI—VI of FIG. 5.
Figure 5:
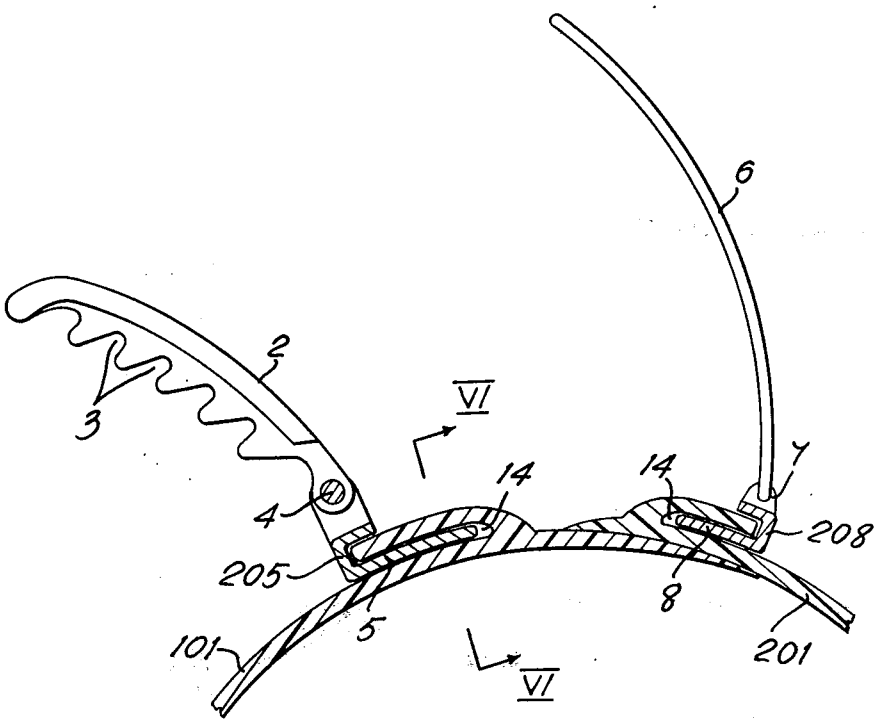
FIG. 5 is a view similar to FIG. 2, of a third embodiment of the invention.

In FIGS. 5 and 6 a still further embodiment of the invention is shown. According to this embodiment, on the upper side of the flaps 101, 201 a sheath like member 14 is formed, inside the recess of which the plate elements 5, 8 are slidably inserted. The plate members 5 and 8 are provided at their rear end with upwardly projecting abutment members 205, 208 to the upper ends of which the lacing members 2, 6 are pivotably secured.

The plate elements 5 and 8 are slightly curved in their longitudinal direction, the same curvature being provided in the recesses of the sheath members 14. Again, the plate members 5, 8 are inserted with a certain frictional fit into the recesses of the sheath members 14, in order to prevent unintentional disengagement of the lacing members from the ski boot.

Having thus fully described my invention, what I claim is:

1. A ski boot including a lacing device comprising a hooked lever like member pivotably supported on a first base plate cooperating with a ring like member pivotably supported on a second base plate, said lacing device members being secured to the ski boot upper at both sides of the longitudinal ski boot opening, characterized by the fact that the said first and second base plates are in the form of slide elements, slide guides being provided on said ski boot upper to accomodate in a dismountable manner with a slide fit the said slide elements.

2. A ski boot according to claim 1, in which the said ski boot upper is made of plastics, and the said slide guides are made integral with the said upper.

3. A ski boot according to claim 1, in which the said slide guides are in the form of strips projecting from the ski boot upper.

4. A ski boot according to claim 3, in which said slide guides have a dovetail cross sectional profile.

5. A ski boot according to claim 3, in which the said slide guides have a T shaped cross sectional profile.

6. A ski boot according to claim 1 in which the said slide guides are in the form of a sheath like element projecting from the ski boot upper.

7. A ski boot according to claim 1, in which the said slide guides are engaged by said slide elements with a frictional fit.

8. A ski boot according to claim 1, in which the said slide guides and the said slide elements are curved in their longitudinal direction.

9. A ski boot according to claim 1, in which abutment means are provided for limiting the sliding movement of the said slide element with respect to the corresponding slide guide.

* * * * *